United States Patent [19]

Hanson

[11] 4,205,949

[45] Jun. 3, 1980

[54] SLIPFORM APPARATUS FOR VERTICAL BORES

[76] Inventor: Raymond A. Hanson, P.O. Box 7400, Spokane, Wash. 99207

[21] Appl. No.: 920,556

[22] Filed: Jun. 29, 1978

[51] Int. Cl.[2] ..... E21D 5/00

[52] U.S. Cl. ..... 425/59; 264/33; 405/133; 405/146; 425/64

[58] Field of Search ..... 425/63, 64, 59; 249/10, 249/11, 12; 264/32, 33; 405/133, 146

[56] References Cited

U.S. PATENT DOCUMENTS

| | | | |
|---|---|---|---|
| 2,520,199 | 8/1950 | Butcher . | |
| 3,032,852 | 5/1962 | Hanson . | |
| 3,049,783 | 8/1962 | Hanson . | |
| 3,206,824 | 9/1965 | Cerutti . | |
| 3,350,889 | 11/1967 | Sturm | 405/146 X |
| 3,377,669 | 4/1968 | Burgess . | |
| 3,613,379 | 10/1971 | Jacobs | 405/146 X |
| 3,613,384 | 10/1971 | Jacobs | 405/146 X |
| 3,792,942 | 2/1974 | Cole | 425/63 X |
| 3,877,855 | 4/1975 | Hanson | 425/59 |
| 4,031,708 | 6/1977 | Hanson | 425/59 X |
| 4,055,958 | 11/1977 | Hanson | 425/59 X |
| 4,067,675 | 1/1978 | Hanson | 425/59 |

*Primary Examiner*—Philip Anderson

*Attorney, Agent, or Firm*—Wells, St. John & Roberts

[57] ABSTRACT

A slipform apparatus is described for forming a continuous upright monolithic lining within a preformed upright shaft. The slipform is provided in three independently movable sections that may be lowered into the shaft. Wet concrete is delivered to the sections and dispensed outwardly of the sections to form the lining. The formed sections hold the wet concrete against the walls of the shaft and progressively form a cylindrical upright bore within the shaft. As concrete is delivered to the slipform, the individual sections are moved in an "inchworm" effect in conjunction with an expansion mechanism to automatically lift itself upwardly within the shaft as the lining is being formed. A steering mechanism is provided to enable selective angular movement of the slipform in a nonvertical plane.

11 Claims, 17 Drawing Figures

SLIPFORM APPARATUS FOR VERTICAL BORES

BACKGROUND OF THE INVENTION

The present invention is related broadly to the field of earth engineering equipment and more specifically to such equipment for lining upright shafts previously formed in the earth's surface.

In mining operation, central mining shafts, winding shafts, blind shafts, and ventilation shafts lead vertically downward from the earth's surface to and often beyond horizontal tunnels. Such shafts may extend from the earth's surface vertically downward to adjoining tunnels, or they may extend from one tunnel vertically to another tunnel at another elevation. Some vertical shafts, termed "blind shafts", extend downwardly from one tunnel to a closed bottom end. For mining purposes, nearly all vertical shafts must be lined with concrete or masonry to prevent the shaft walls from collapsing or "sloughing" and obstructing ventilation or otherwise isolating the adjoining horizontal tunnel.

During the drilling operation in which such upright shafts are formed, a liquid "drilling mud" may be utilized to assist the drilling operation and to prevent the shaft walls from sloughing onto the boring head. Ordinarily, the shaft is nearly completely filled with such drilling mud and must be pumped dry before conventional lining operations can take place.

Various apparatus and methods have been produced for placing shaft linings in upright dry excavations. Others show such apparatus for lining upright shafts that have been previously filled with "drilling mud". U.S. Pat. No. 4,031,708 granted to me on June 28, 1977 discloses a slipforming method and apparatus for in situ lining of an upwardly open shaft with monolithic concrete. This apparatus utilizes two conical shaped form members that receive wet concrete from an above ground source and spread it downward and outwardly against the walls of the shaft. The concrete is pumped from the above ground supply location and the slipform is intended to be moved upwardly within the shaft by receiving drilling mud from above the slipform and pumping it under pressure to the area below the slipform. Hydraulic pressure therefore serves to continuously move the slipform upwardly within the shaft.

U.S. Pat. No. 4,055,958 granted to me on Nov. 1, 1977 discloses another form of vertically moving slipform apparatus that receives wet concrete pumped under pressure from an above ground source. Again, two conical members receive the pumped concrete to direct it downwardly and outwardly against the shaft walls. In this particular application, however, the slipform is pulled upwardly as concrete is pumped from an above ground location to the vertically moving slipforms below. Another slipform apparatus is disclosed in my U.S. Pat. No. 4,067,675 issued on Jan. 10, 1978. This apparatus is designed to receive concrete under pressure from an above ground source and form it into a shaft lining while moving upwardly in the shaft due to the hydraulic pressure of the concrete being pumped. In other words, the wet, pumped concrete acts against the formed, partially hardened concrete, to push the slipform upwardly in the shaft.

While the above cited apparatus are effective, there is difficulty in controlling the concrete flow and slipform movement with power sources at the above ground location. It therefore becomes desirable to control the vertical slipform movement and delivery of concrete to the slipform within the slipform itself. This is especially true when large diameter linings are to be formed and the lining is to extend to a considerable depth. The weight of form members used to produce large diameter linings is extremely high and may cause strain on the usual form lifting equipment, especially when the shaft depth is considerable. If tension along lifting devices such as tremmie tubes, drilling rods, cables, etc. is to be held at an allowable level, and if accurate control of ascent is necessary, it becomes desirable to provide at least part of the lifting force through the slipform itself. Elongation of the lifting connectors would be held to a minimum, thereby decreasing the chance of damage due to stress and increasing accuracy of control.

Other form members utilized in lining upright shafts often incorporate a movement that is commonly known as "jump forming". This process has been reasonably effective but necessitates that the shaft be dry and drilled oversize in order to accommodate an outside form member for forming an outside surface of the lining. It further requires that workers be sent down the shaft in order to effectively operate the form members and spread the concrete evenly about the lining between an inside and outside form member. The danger of falling debris from sloughing shaft walls is ever present; plus the expense involved in labor is a prohibitive factor.

It therefore becomes desirable to obtain some form of slipform apparatus for forming a monolithic lining within preformed vertical shafts that may be operated to lift itself upwardly within the shaft. This is achieved as the lining is formed by pumping concrete directly from the slipform itself to maximize control of the slipform within the shaft regardless of its elevation therein. It is also desirable to obtain some type of slipform that may be "steered" within the shaft to accommodate shaft walls that are not completely vertical.

DETAILED DESCRIPTION OF A PREFERRED EMBODIMENT

Figure 1:
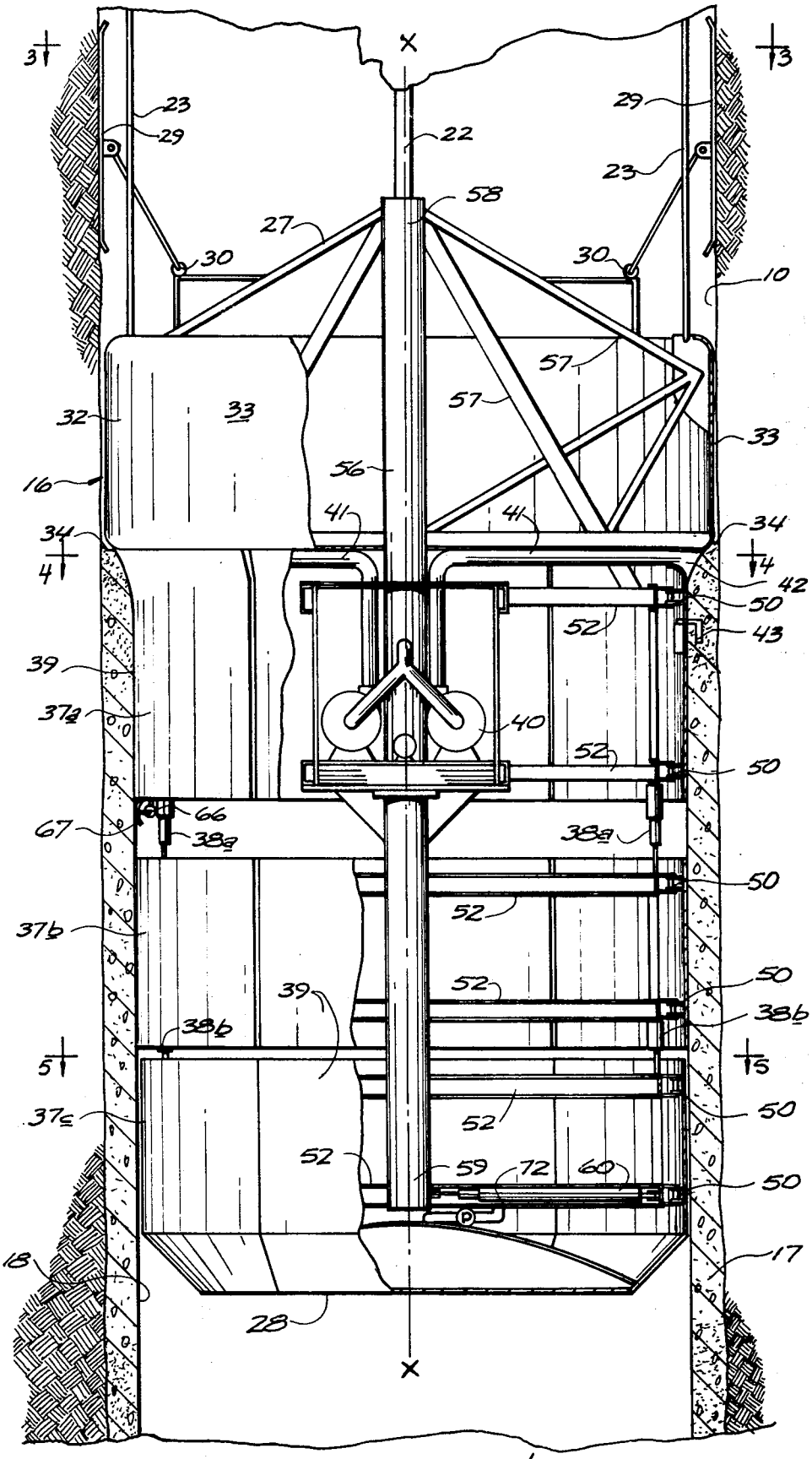
FIG. 1 is a sectional view illustrating the present slipform apparatus within a vertically oriented shaft.
Figure 2:
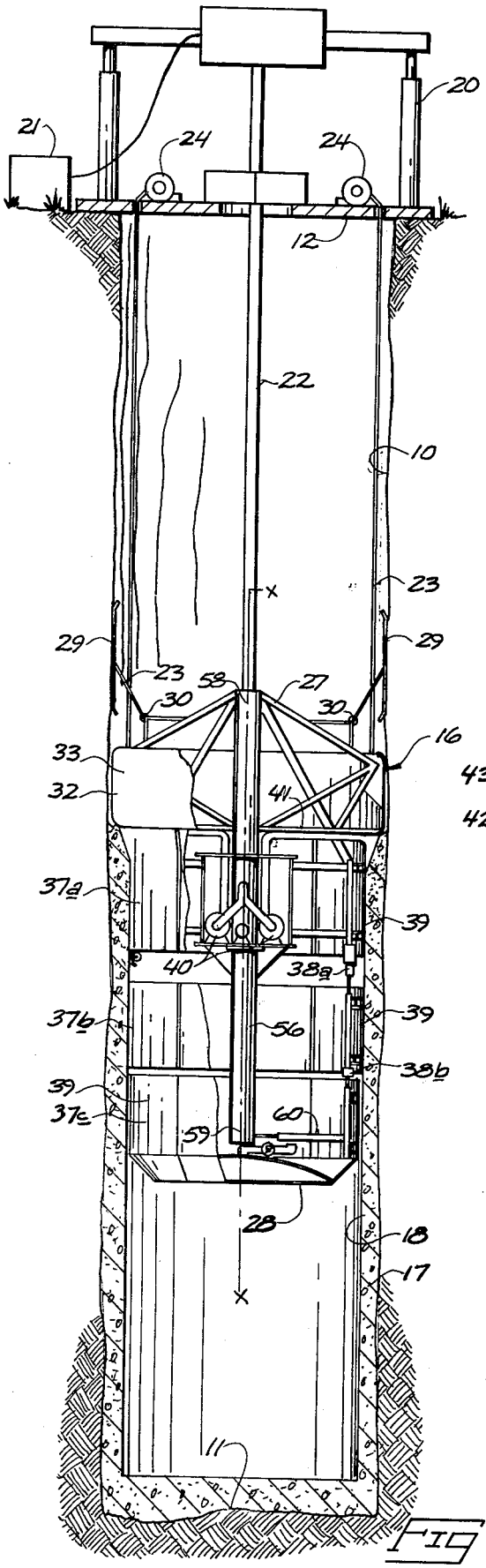
FIG. 2 is a reduced cross-sectional view showing the slipform in a shaft with associated mechanisms at an above ground location.
Figure 3:
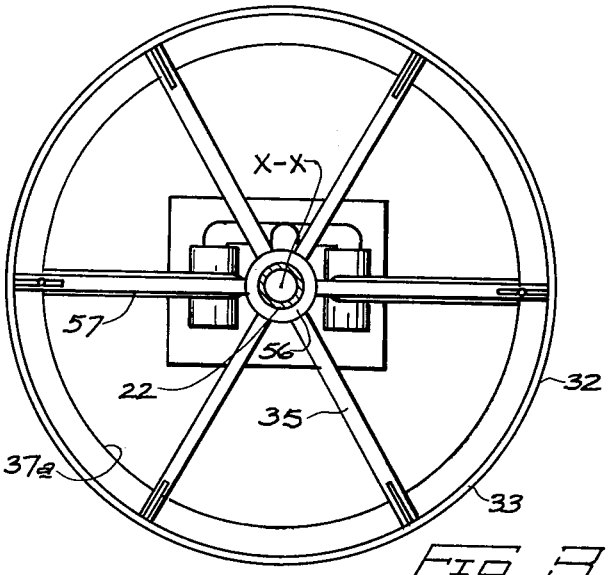
FIG. 3 is a cross-sectional view taken substantially along line 3—3 in FIG. 1.
Figure 4:
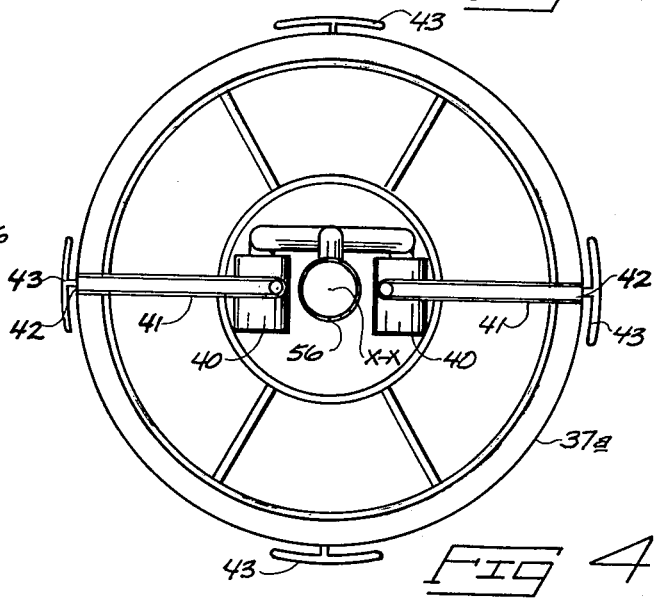
FIG. 4 is a cross-sectional view taken substantially along line 4—4 in FIG. 1.

A slipform exemplifying the present invention is illustrated in FIGS. 1 and 2 of the accompanying drawings within a drilled shaft 10 leading from a bottom 11 to an open upper end 12. The present slipform apparatus is used to form a concrete monolithic lining 17 along the shaft 10 with an open central bore defined by a cylindrical wall 18. The lining 17 is formed in place within the shaft 10 by operation of the present slipform apparatus, as designated at 16.

A derrick 20 (FIG. 2) is provided above ground to initially support the slipform 16, or to selectively elevate the slipform within the shaft. A concrete supply source 21 is operatively associated with the derrick 20 to supply wet concrete to a vertical "tremmie tube" or "slickline" 22. Slipform 16 may be suspended from the line 22 or by the same drill shank or rod used in drilling the shaft 10.

The line 22 is also used to receive wet concrete from the supply source 21 and to deliver it to the slipform. The wet concrete is then forcibly pumped outwardly to the area between the slipform periphery and the shaft wall to form the lining 17.

It is noted that complete ground level support for the slipform is required only when the form is being lowered to the shaft bottom 11 or when it is necessary to raise the form without correspondingly forming the lining 17. The slipform 16 as designed is capable of moving itself upwardly within the shaft as the lining 17 is formed. However, in practice the line 22 will be supported at ground level and will be held preferably under slight tension to prevent bending or wavering along its length.

Elements of the present slipform 16 are illustrated in more detail in FIGS. 1, 3 through 6 and 15 through 17. It basically includes a top end 27 and a bottom end 28 that are normally aligned along a central axis X—X within the shaft 10. The central axis X—X is illustrated and referred to in the specification and claims as an aid in describing and defining the invention.

Figure 11:
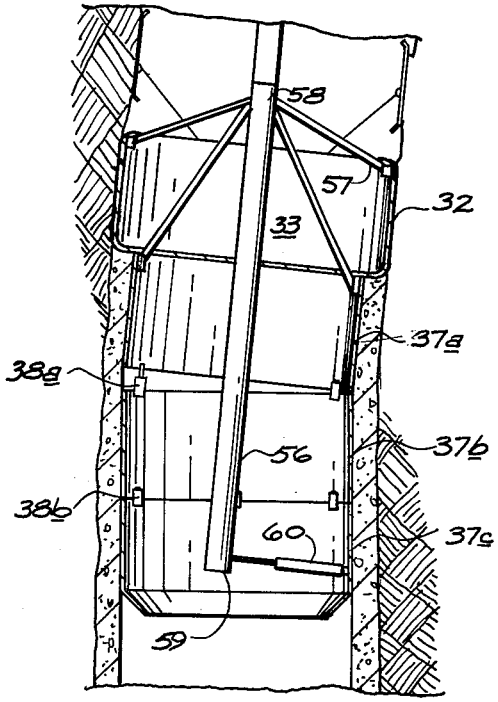
FIG. 11 is a diagrammatic view of the present slipform with a preferred form of steering mechanism.
Figure 12:
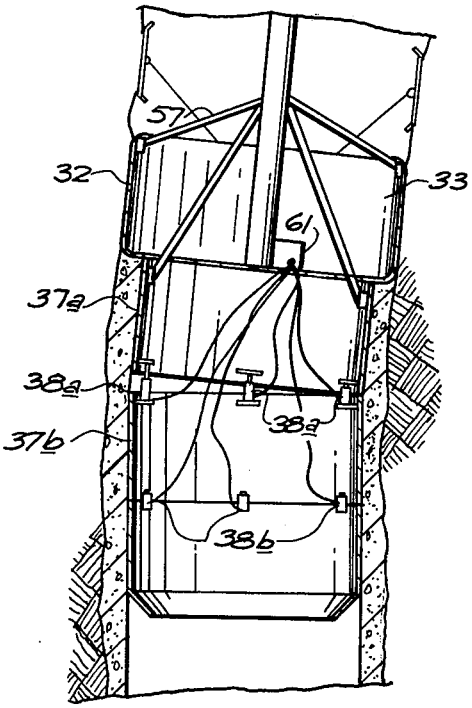
FIG. 12 is a view similar to FIG. 11 only showing an alternate form of steering mechanism.
Figure 13:
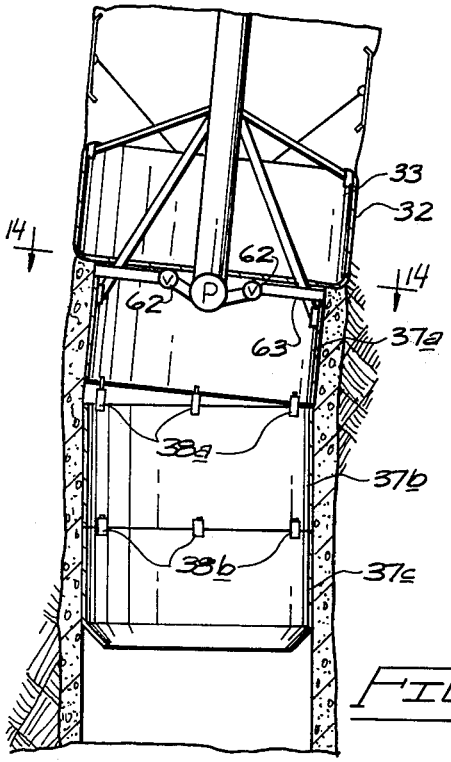
FIG. 13 is a view similar to FIG. 11 only showing another alternate steering mechanism.

The slipform 16 will normally move upwardly along the central axis X—X unless some obstacle is encountered or unless the shaft itself has been drilled partially along an off-vertical axis as illustrated in FIGS. 11 through 13.

The slipform 16 is guided along shaft 10 by angularly spaced guide skis 29 located at the upper slipform end 27. The guide skis 29 may be pivoted relative to the slipform in response to engagement with irregularities along the walls of the slipform. Sensors 30 pivotably mounting the guide skis 29 may be used to indicate changes in the orientation of skis 29 at the ground surface or at controls provided within the slipform itself.

Below the skis 29 is a seal 32 that is substantially complementary in cross section to the configuration of the shaft 10. The seal 32 acts as means for preventing escape of concrete above the slipform from the area between the slipform and shaft walls as the slipform is moved upwardly within the shaft to form the lining 17. Seal 32 may include a cylindrical vertical wall 33 of a diameter slightly less than the complementary diameter of the shaft 10. The gap between wall 33 and shaft walls is insufficient to allow escape of concrete to an area above the slipform and yet is spaced from the shaft walls by a distance sufficient to enable free vertical movement of the seal 32 within the shaft. The wet concrete level may therefore be maintained between wall 33 and the shaft wall as the slipform moves upwardly.

Below the seal 32 are three form sections 37*a*, 37*b*, and 37*c*, the top section 37*a* being integral with seal 32. These form sections are connected end to end and substantially aligned along the central upright axis X—X. More specifically, they include the top form section 37*a* that is integral with seal 32, an intermediate section 37*b* and a bottom form section 37*c*. The form sections 37*a–c* include outer surfaces 39 that are joined to form a cylindrical cross-section. These surfaces 39 form the lining wall 18.

Figure 5:
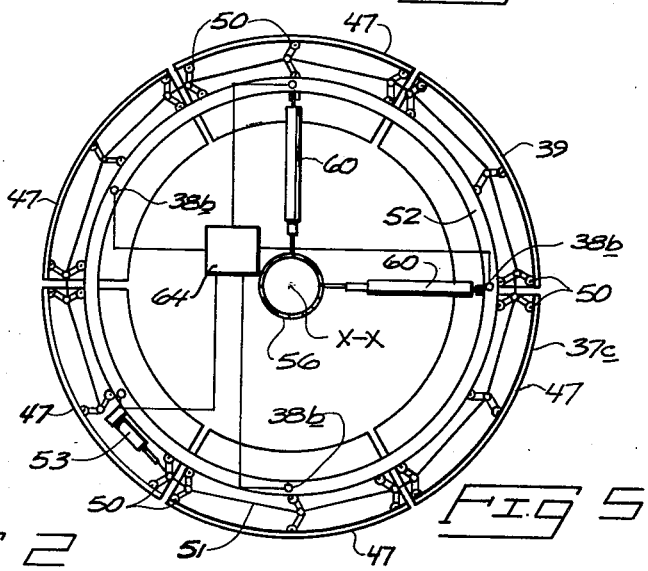
FIG. 5 is a cross-sectional view taken along line 5—5 in FIG. 1.

The sections are individually interconnected by a plurality of power units 38*a*, 38*b* that may function as means for individually sliding the sections relative to one another in order to progressively move the slipform upwardly within the shaft. The individual power units 38*a*, 38*b* may be grouped into a top set including units 38*a* and a bottom set including units 38*b*. The top set of power units 38*a* interconnect the top form 37*a* and intermediate form 37*b*. The bottom set of units 38*b* interconnect the intermediate form 37*b* with the bottom section 37*c*. The power units 38*a* and 38*b* may be in the form of jack cylinders that are equiangularly spaced about the central axis X—X (FIG. 5).

Figure 15:
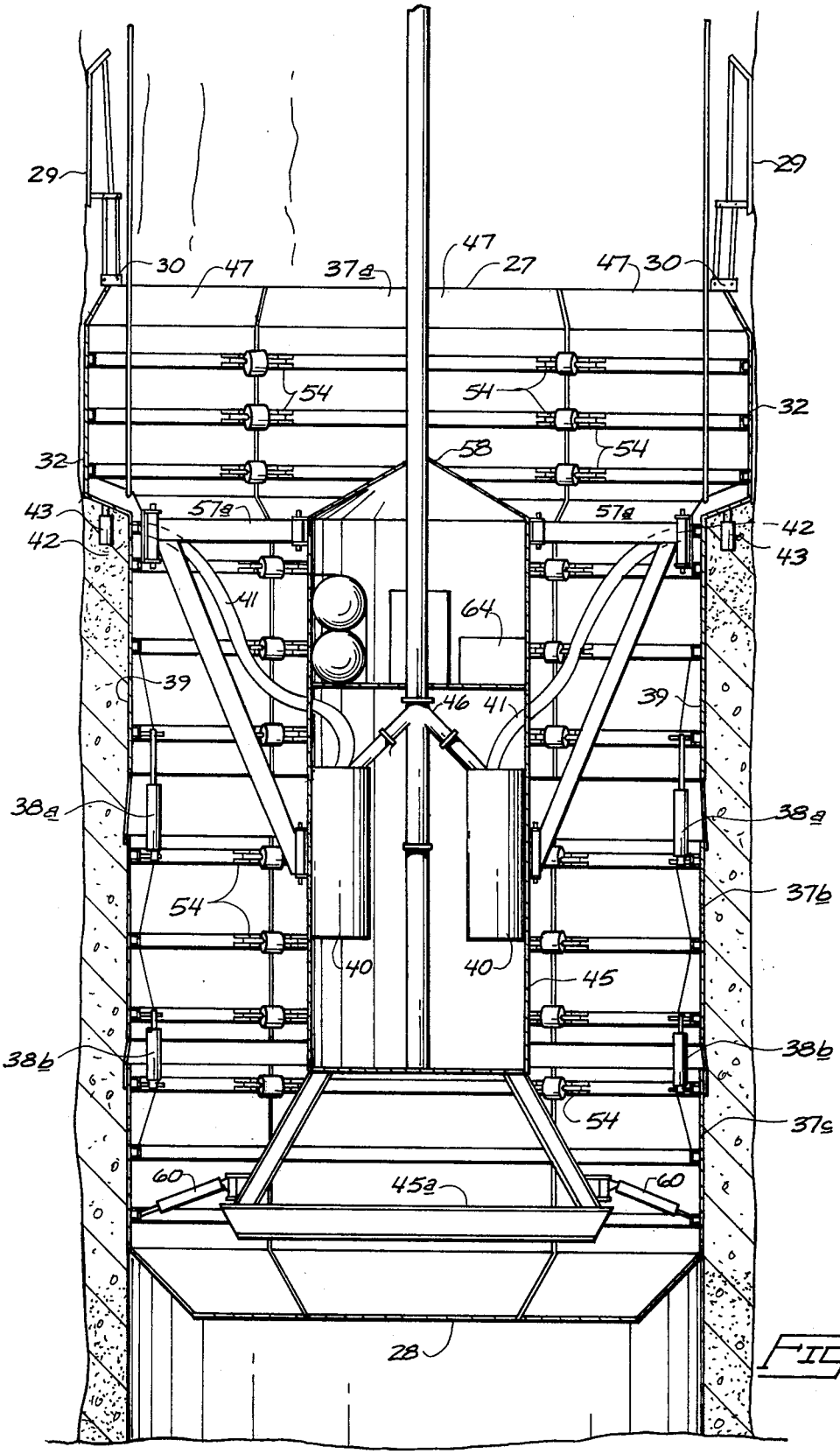
FIG. 15 is a sectional elevation view of another form of the present slipform.

Wet concrete is supplied through line 22 and is forceably discharged into the area within the shaft between the outer surfaces 39 and shaft walls. Delivery of concrete received from source 21 is accomplished directly by means of one or more supply pumps 40 that may be mounted to the seal 32 and top form sections 37*a* (FIGS. 1 and 2). FIG. 15 shows the pumps located in a central equipment housing 45. Two or more delivery tubes 41 extend radially outward from the pumps 40 to discharge ends 42 at the outer surfaces 39. Concrete is forcibly discharged through ends 42 into the area immediately below seal 32 and intermediate the shaft wall and outer surfaces 39. A purge or dump valve mechanism 46 may be provided (FIG. 15) to enable purging of the line 22 and of the discharge tubes 41 through pumps 40.

Vibrators 43 may be provided in order to consolidate and aid in even dispersion of the wet concrete around the outer form section surfaces 39. They are located within the space between surfaces 39 and the shaft wall, adjacent the discharge openings 42.

The seal 32 and the form sections 37*a–c* are each comprised of several interconnected arcuate segments 47 that are normally joined end-to-end along vertical edges. A flexible seal (not shown) may be provided between the edges to prevent seepage of wet concrete into the area confined by the form section.

Figure 6:
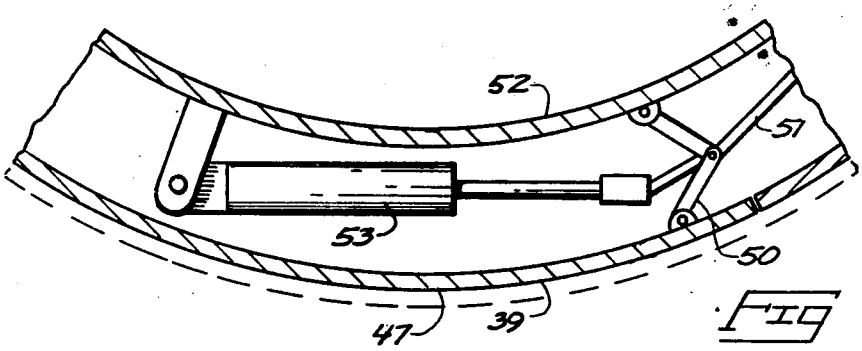
FIG. 6 is an enlarged fragmentary view of a portion of the present invention.
Figure 16:
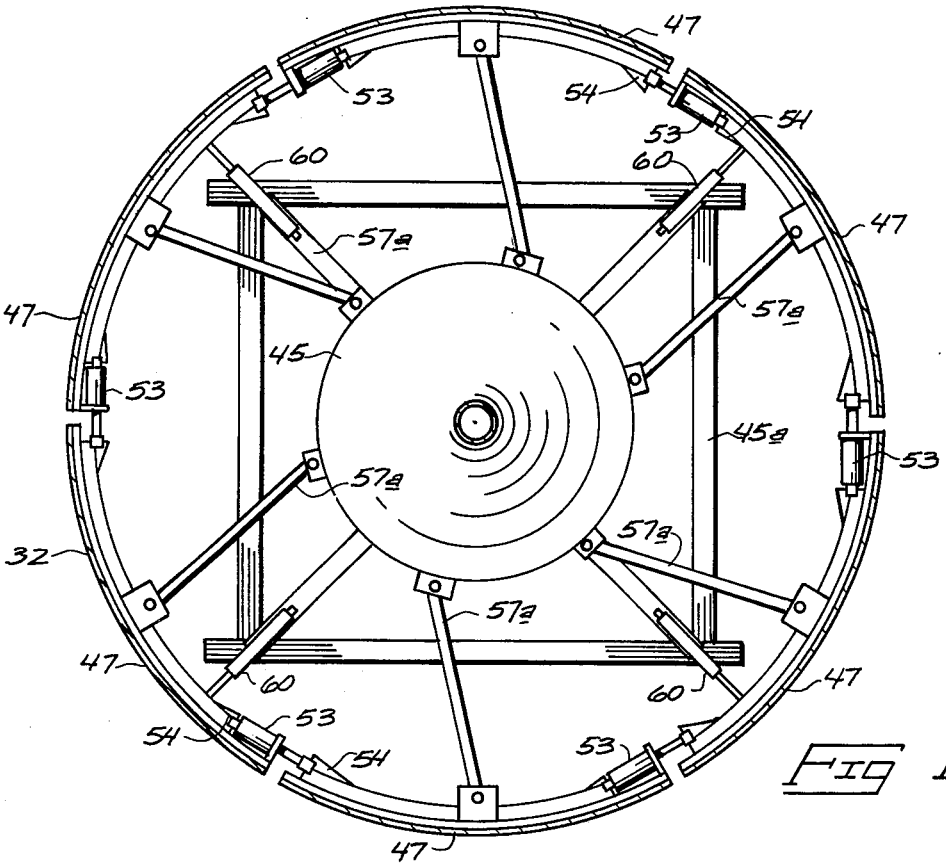
FIG. 16 is a plan view of the form shown in FIG. 15.
Figure 17:
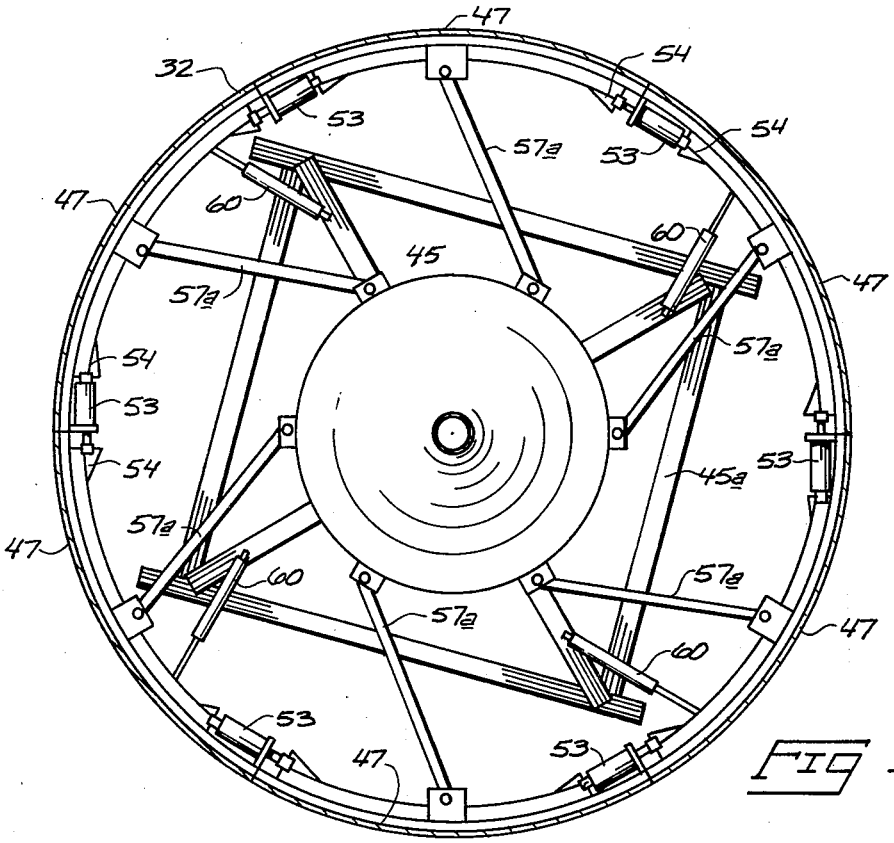
FIG. 17 is a view similar to FIG. 16 only showing the form in a different operational mode.

Segments 47 are radially movable between expanded and contracted positions. For example in FIG. 1 the seal 32, top form section 37*a* and intermediate section 37*b* are shown in the expanded condition. FIG. 6 and FIGS. 16 and 17 also illustrate the expanded and relaxed conditions of the segments 47. The dashed line position of the fragmented segment shown in FIG. 6 illustrates the extended position, while the solid line indicates the retracted position. Also, FIG. 16 shows a retracted position while FIG. 17 shows an extended position. The segments 47 are moved between the extended and retracted positions by an expansion means that interconnects the segments 47 of the seal 32 and each section 37*a–c*.

The expansion means may include, as shown in FIGS. 5 and 6, a plurality of toggle links 50 that extend about the form sections 37 and are interconnected within each section by a cable 51. Each toggle link 50 is mounted at one end to a segment 47 and at an opposite end to a circular ring 52. One or more expansion cylinders 53 are provided for each form section. Each cylinder 53 is connected at one end to ring 52 and at the opposite end to cable 51. The expansion cylinders 53 may be selectively contracted to straighten the toggle links 50 and thereby push the segments 47 radially outward relative to the ring 52 and against the lining 17.

The expansion means is shown in an alternate form by FIGS. 15–17. There, only the cylinders 53 are used to expand or contract the cross-sectional diameter of the slipform between the positions shown in FIGS. 16 and 17. Brackets 54 are provided in pairs on each side of the vertical edges of the segments. The cylinders 53 are mounted between the brackets so their extension will cause corresponding expansion of the slipform and contraction will allow the forms to either return to a normal condition or to an inwardly retracted position to facilitate unobstructed raising and lowering of the slipform in the shaft. The expansion cylinders 53 and interconnecting cables 51 or the cylinders 53 themselves, may therefore function as a jack means for causing expansion of the segments 47.

The upper section **37*a* is suspended by line 22 through the use of brace frame members 57 shown in FIGS. 1 and 2 as connected between two rings 52 and a central upright rigid shaft 56. Shaft 56 is coaxial with line 22 and may be utilized as an extension of the line 22 for concrete supply purposes. It should be noted that the brace frame members are connected only to the rings 52 of the seal 32 and top form section 37*a*. The remaining sections 37*b* and 37*c* therefore depend from form section 37*a***.

Brace frame members **57*a* are shown in FIGS. 15–17 mounted directly between form section 37*a* and the central equipment housing 45 (which functions substantially the same as the upright rigid shaft 56). Members 57*a* are pivoted both to the equipment housing 45 and to section 37*a* about axes parallel to the central axis X—X. The members 57*a*, however, are not radially oriented with respect to the central axis X—X. Instead, the brace members 57*a* are normally oriented at equal acute angles to radial lines from the central axis as shown by FIG. 17. This arrangement enables pivotal movement of the brace members 57*a* as the seal 32 and form section 37*a* are expanded and contracted. The relative angular positions may be distinguished by comparing FIG. 16 (expanded) with FIG. 17** (contracted).

The expansion feature is utilized to secure part of the slipform to the formed lining 17 while one of the sections is moved upwardly along the central axis. The expansion means provided at least in part by expansion cylinders 53 may be operatively connected to the individual power units **38*a*, 38*b* through a central control 64, diagrammatically illustrated in FIG. 5. The control 64 may be provided to synchronize operation of the cylinders 53 and selected power units 38*a* or 38*b*** in cycles to produce an "inchworm" effect that will be described in greater detail below.

It is doubtful that a shaft 10 can be formed along a perfectly vertical central axis such as that illustrated at X—X. Often, the shaft angle will vary slightly along its length due to variable soil conditions and efficiency of the boring head and attached drilling apparatus. Therefore, the present invention is provided with a steering mechanism by which the angular position of the slipform, as it moves upwardly in the shaft, may be changed to an "off-vertical" relationship. Several alternate mechanisms may be utilized to perform the steering function that may be required in a shaft having at least a portion of its length lying along a nonvertical axis.

Two forms of the steering arrangement are illustrated in FIGS. 1, 2, 5, 11, and 15–17. It may include a central upright rigid shaft 56 or equipment housing 45 that normally extends along the central axis X—X. The shaft 56 and housing 45 each extend from a top end 58 downwardly through the form sections **37*c* to a bottom end 59 located within the confines of the bottom form section 37*c*. The bottom end 59 of shaft 56 is connected with the bottom form section 37*c* by jack cylinders 60. The equipment housing 45 includes a rectangular framework 45*a* that is connected at its four corners by four of the jack cylinders 60**.

The jack cylinders 60 are preferred as means for selectively laterally shifting the lower end of shaft 56 or housing 45 to thereby change the upright orientation of the seal 32 and form section **37*a* attached thereto. The cylinders 60 of FIGS. 1 and 5 are radially oriented within the bottom form section 37*c* at right angles to one another as illustrated in FIG. 5. Cooperation of the cylinders may result in lateral displacement of the shaft bottom end 59 at a selected angle within the confines of the lining. It is noted that there is little need to deflect the shaft end 59** to any substantial degree since the amount of offset of the shaft will seldom be more than 1 or 2 degrees from the vertical.

The four cylinders shown by FIGS. 15–17 accomplish the same function as described above except that they are arranged differently to facilitate expansion and contraction of the bottom form section **37*c*. Therefore, the cylinders 60 are mounted at offset (acute) angles to radii from the central axis when the section 37*c* is in its contracted state (FIG. 17), but are pivoted to radial positions when section 37*c* is expanded (FIG. 16). This is done so the cylinders can act radially against the housing 56 to "steer" the slipform when the section 37*c*** is in its expanded condition.

Operation of the cylinders 60 and shaft 56 is illustrated in exaggerated form in FIG. 11. Operation of cylinders 60 against housing 45 is substantially the same as that shown in FIG. 11 and described below. It is necessary to exaggerate the angular offset of the shaft with the central axis X—X in order to appropriately illustrate the function of the steering mechanisms described above. The offset of the shaft 56 or housing 45 and attached top form section **37*a* is possible since the concrete being delivered at the upper edge of top form section 37*a* is in a plastic state while the concrete at the bottom form section 37*c* has substantially hardened. Therefore, the cylinders 60 may operate against a stationary surface to tilt the shaft or housing and attached form section 37*a*** to a selected degree against the resistance offered by the surrounding wet concrete.

A second form of steering mechanism is illustrated in FIG. 12. It includes an auxiliary control diagrammatically shown at 61 for selectively controlling operation of the individual power units **38*a*. Therefore, the power unit 38*a* shown at the left in FIG. 12 may be operated to extend further than the unit on the right hand side. This will result in angular deflection of the top form member 37*a* and attached seal 32. The individual power units 38*b* interconnecting the intermediate section 37*b* and bottom section 37c may also be operatively connected to the control 61 to better facilitate tracking by the lower two sections along the vertically offset path of travel as determined by the top form section 37a and seal 32**.

Figure 14:
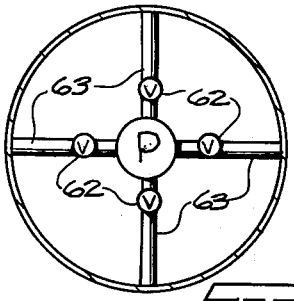
FIG. 14 is a sectional view taken along line 14—14 in FIG. 13.

Another form of steering mechanism is illustrated in FIGS. 13 and 14. This form utilizes a modified version of the pump and delivery mechanism to selectively distribute concrete at one side or another of the form depending upon the curvature of the shaft. Here, for example several concrete distribution valves 62 may operate in conjunction with several discharge tubes 63 equiangularly spaced about the vertical central axis (FIG. 4) as means for directing the flow of concrete to a selected angular area between the slipform and the shaft wall. The desired angular deflection may be obtained by closing the valves 62 on one side of the form and delivering concrete under pressure to the opposite side. Combined use of the valves 62 may facilitate angular movement of the slipform to follow substantially any minor variation in the previously drilled shaft 10.

It is contemplated that the present slipform be moved upwardly within the shaft at a rate commensurate with the curing rate of the concrete so it will leave a self-supporting monolithic lining as it moves along. In order to assure that the slipform is moving at the desired rate, a sensing unit 66 (FIG. 1) may be provided having a foot 67 that will slide along the lining wall adjacent a lower edge of the top form section 37a. The sensing unit 66 may deflect when the slipform is being moved upwardly at a rate greater than the curing rate of the delivered concrete. If the foot 67 is moved either in or outwardly by noncured concrete, the attached sensing unit 66 will send a signal to a control system (not shown) that will respond by appropriately reducing the rate of upward progress.

Figure 7:
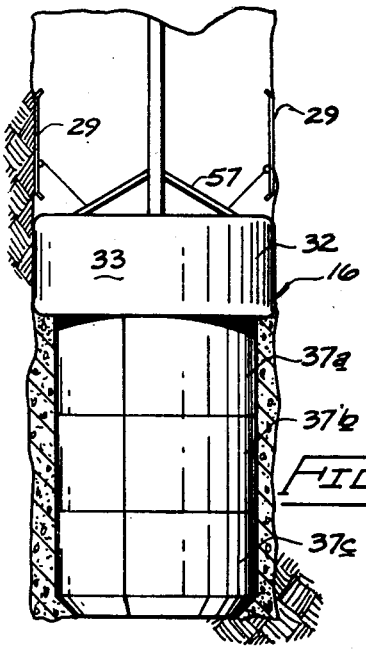
FIGS. 7 through 10 are diagrammatic illustrations of the present slipform during operation.
Figure 8:
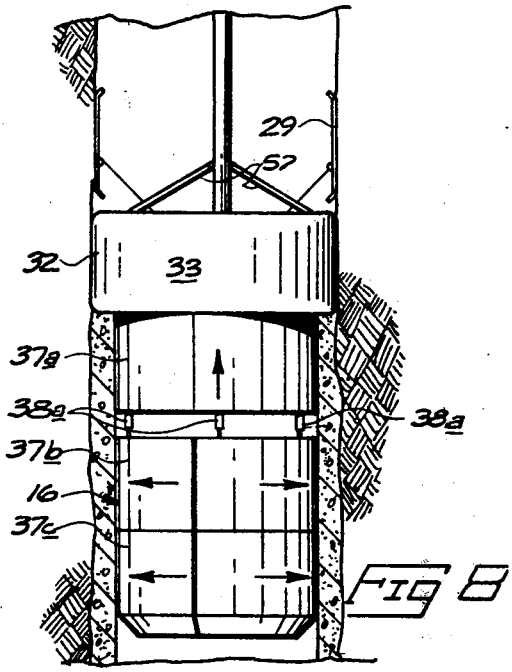
Figure 9:
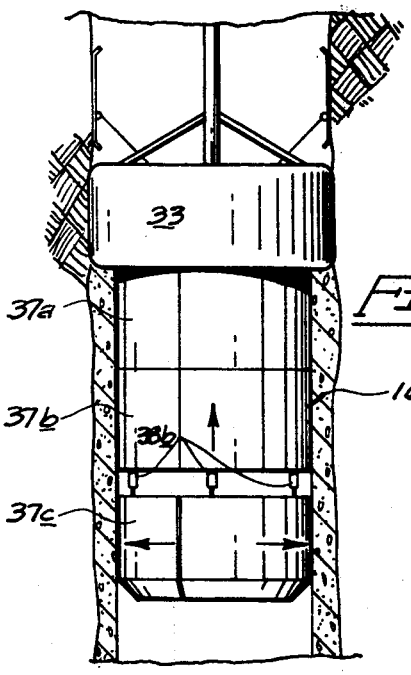

FIGS. 7 through 9 illustrate normal operation of the present slipform assembly. Initially the sections 37a–c are contacted and the slipform is lowered to the shaft bottom 11 by the line 22. The lower edge of bottom form section 37c might come to rest against the shaft bottom 11 (FIG. 7). A supply of concrete is mixed and ready to be delivered through the line 22 to the slipform. The supply pumps 40 then initiate delivery of concrete to start the lining procedure. The form remains momentarily at the bottom of the shaft while the concrete is initially delivered to completely encircle the form sections. The slipform begins its upward progress as the concrete starts hardening about the independently movable form members.

Alternatively, a pre-formed cap or plug (not shown) may be carried by the slipform downwardly to the shaft bottom 11. Details of a cap or plug and discussion of its use are given in my prior U.S. Pat. No. 4,067,675 which is hereby incorporated by reference into the present application.

When the initially delivered concrete becomes sufficiently self-supporting, the cylinders 53 within intermediate form section 37b and bottom form section 37c may be actuated to expand the associated outer surfaces 39 as illustrated in FIG. 8 or FIG. 16. This anchors sections 37b and 37c to the already formed portion of lining 17 and provides a solid surface for the top set of individual power units 38a to operate against. These cylinders may be extended to lift the top form section 37a and seal 32 upwardly within the shaft as a select amount of concrete is delivered by pumps 40 to completely fill the area between the outer surface 39 of the top form section and shaft wall.

The elevational movement of the section 37a is timed in relation to the curing time required for the delivered concrete. Therefore, the concrete immediately below the top form section 37a may be in a nearly hardened, self-supporting state as the slipform is moved upwardly.

The next step in the upward movement of the slipform within the shaft is the elevational movement of intermediate section 37b. This may be accomplished by anchoring bottom form section 37c against the lining walls. The cylinders 53 within the intermediate section 37b may then be relaxed to allow its outer surfaces 39 to contract slightly and enable sliding movement of section 37b along the lining wall.

The bottom set of individual power units 38b may be actuated to extend and elevationally move intermediate form section 37b upwardly into contact with the bottom surface of top form section 37a. The top set of cylinders 38a are either controlled to function in a neutral capacity or they may be operated to contract in unison with units 38b.

Figure 10:
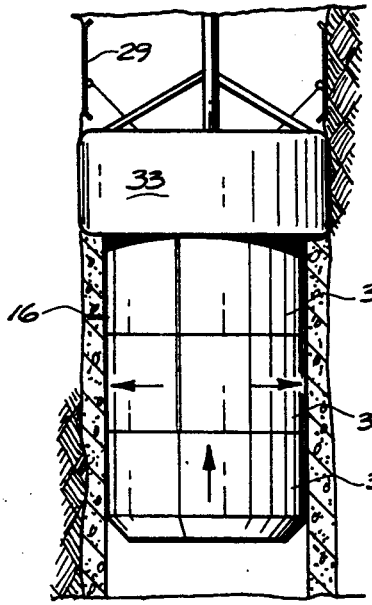

FIG. 10 illustrates the final step in bringing the bottom form section 37c upwardly to complete an operative cycle of the "inchworm" effect utilized to progressively raise the slipform within the shaft as the lining is being formed. This step may be accomplished by expanding intermediate section 37b against the lining. This anchors the slipform against downward movement while the bottom set of individual power units 38b are actuated to contract and lift the bottom form section 37c upwardly into engagement with the intermediate form 37b. Prior to this action, however, the cylinders 53 associated with the bottom form section 37c are relaxed, allowing section 37c to move to a contracted condition. Its surfaces 39 may slide freely against the walls of the concrete lining.

This step brings the slipform to nearly the same condition illustrated in FIG. 7. However, for the slipform to continue on upwardly it is necessary that the process start again with the sections being operated as shown in FIGS. 8, 9 and 10. The cycle can be repeated continuously in response to control 64. Thus, a sequence is followed once the form is elevated from the shaft bottom 11 that starts with the form sections in the condition shown graphically by FIG. 8 and completing a circuit through FIG. 10, the circuit being repeated continuously until the form reaches the open upper end 12 on the shaft.

During the upward movement in the shaft, the sensors 30 located along the guide skis 29 may indicate that the shaft is leading in a nonvertical direction. The amount of angular offset of the shaft or housing may be determined and appropriate steps taken with the steering mechanism to enable the slipform to follow the nonvertical course. The amount of angular offset of the shaft will rarely ever be more than one or two degrees from the vertical central axis X—X. Therefore, functioning of the steering mechanism and upward cyclical movement of the form sections will not conflict to bind the form sections within a sharply angled turn along the shaft.

The above description was set forth merely to exemplify the present invention. It is understood that various changes and modifications may be made from the disclosure without departing from the scope of the invention. Only the following claims are to be taken as restrictive limitations upon the scope of my invention.

What I claim is:

1. An apparatus for receiving concrete through a slickline from an above ground source and for progressively forming an open vertical bore monolithic lining while being moved upwardly along the walls of an upwardly open vertical shaft; comprising:

a slipform having opposed upper and lower ends;

seal means at the upper slipform end receivable within the shaft to prevent vertical escape of concrete from an area radially adjacent the slipform to an area above the slipform;

a form section mounted to the slipform at an elevation below the seal means, said form section having an outer surface complementary to a desired cross-sectional configuration of the vertical lining bore and slidable within the shaft along a vertical central axis;

pump means mounted to the slipform adjacent the seal means, said pump means having an intake for operable connection to the slickline to receive concrete therefrom and having horizontally disposed discharges opening into the area between the shaft wall and outer surface of the form section at an elevation spaced downward from the seal means for discharging concrete under pressure about the form section;

steering means on said slipform for selectively changing the angular relationship of the form section and seal means to an off-vertical orientation within the shaft and to allow movement of the slipform upwardly in a nonvertical direction; and means for moving the slipform upwardly within the shaft at a rate commensurate with the curing rate of the concrete discharged about the form section.

2. An apparatus for receiving concrete through a slickline from an above ground source and for progressively forming an open vertical bore monolithic lining while moving upwardly along the walls of an upwardly open vertical cylindrical shaft, comprising:

a slipform having opposed upper and lower ends;

cylindrical seal means at an upper slipform end receivable within the shaft to prevent escape of concrete from an area within the shaft radially adjacent the slipform to an area above the slipform;

a cylindrical form section mounted to the slipform at an elevation below the seal means, said form section having a cylindrical outer surface complementary to a desired cross-sectional diameter of the vertical lining bore and slidable within the shaft along a vertical central axis;

pump means mounted on the slipform adjacent the seal means, said pump means having an intake for operable connection to the slickline and having a plurality of discharges spaced equiangularly about the central axis and opening into the area between the shaft wall and outer surface of the form section at an elevation below the seal means for forcibly discharging concrete about the form section and into the area between the shaft wall and outer form surface;

steering means for selectively changing the angular position of the seal means and form section in relation to the central axis to an off-vertical orientation within the shaft and to allow movement of the slipform upwardly in a nonvertical direction; and means for moving the slipform upwardly within the shaft at a rate commensurate with the curing rate of the concrete delivered and formed about the form section.

3. An apparatus for receiving concrete through a slickline from an above ground source and for progressively forming an open vertical bore monolithic lining while moving upwardly along the walls of an upwardly open vertical cylindrical shaft, comprising:

a slipform having opposed upper and lower ends;

cylindrical seal means at an upper slipform end receivable within the shaft to prevent escape of concrete from an area within the shaft radially adjacent the slipform to an area above the slipform;

a cylindrical form section mounted to the slipform at an elevation below the seal means, said form section having a cylindrical outer surface complementary to a desired cross-sectional diameter of the vertical lining bore and slidable within the shaft along a vertical central axis;

pump means mounted on the slipform, said pump means having an intake for operable connection to the slickline to receive concrete therefrom, and having a plurality of discharge tubes spaced equiangularly about the central axis and opening into the area between the shaft wall and outer surface of the form section at an elevation spaced downward from the seal means for pressurizing and delivering concrete from the slickline under pressure to the area between the outer surface of the form section and the shaft wall;

steering means associated with the pump means for controlling the flow of concrete through the individual discharge tubes to produce differential concrete pressure about the central axis and thereby change the angular relationship of the seal means and form section to the vertical central axis; and means for moving the slipform upwardly within the shaft at a rate commensurate with the curing rate of the concrete discharged about the form section.

4. The apparatus as defined by claim 3 wherein the steering means includes a selectively operable valve in each discharge tube for regulating flow of concrete therethrough.

5. The apparatus as defined by claim 3 further comprising expansion means for expanding the outer surface of the form section transversely in relation to the vertical central axis.

6. The apparatus as defined by claim 3 further comprising power means on the slipform for moving the slipform vertically within the shaft.

7. The apparatus as defined by claim 3 further comprising expansion means for expanding the form section transversely with respect to the vertical central axis and wherein the expansion means includes:

a closed ring within the form section having sides inwardly spaced from the form segment;

a plurality of toggle links pivotally joined to the closed ring and form section; and jack means interconnecting the toggle links for selectively operating the toggle links to extend against the closed ring and form segment to force transverse expansion of the form section.

8. The apparatus as defined by claim 3 wherein the steering means is included within the pump means and includes a concrete distribution means operable to deliver concrete under selected pressure to selected angular areas about the outer surface area of the form section to force the adjacent form section to tip angularly relative to the central axis.

9. The apparatus as defined by claim 3 wherein a plurality of the form sections are provided below the seal means, connected end-to-end and coaxial along the vertical central axis and wherein each form section is comprised of a plurality of interconnected form segments movably interconnected to define the outer surfaces of the form sections and to enable radial contraction and expansion thereof.

10. The apparatus as defined by claim 3 wherein the slipform supports a plurality of axially adjacent form sections and the last-named means comprises individual power units interconnecting the adjacent paris of form sections, said last-named means being selectively operable to slide the form sections within the shaft independently of one another along the central axis.

11. The apparatus as defined by claim 3 further comprising a sensing unit on the form section having a feeler foot thereon for engaging and sliding over the concrete lining to detect consistency of the lining as it is being formed.

* * * * *

UNITED STATES PATENT OFFICE

CERTIFICATE OF CORRECTION

Patent No. 4,205,949 Dated June 3, 1980

Inventor(s) Raymond A. Hanson

It is certified that error appears in the above-identified patent and that said Letters Patent are hereby corrected as shown below:

Column 1, immediately after the title, insert the following new paragraph:

The Government has rights in this invention pursuant to Contract No. DE-AC22-76ET12482 awarded by the U. S. Department of Energy.

Signed and Sealed this

Fourth Day of May 1982

[SEAL]

Attest:

GERALD J. MOSSINGHOFF

Attesting Officer

Commissioner of Patents and Trademarks